US010191433B2

(12) United States Patent
Watanabe

(10) Patent No.: US 10,191,433 B2
(45) Date of Patent: Jan. 29, 2019

(54) SHEET FEEDING TIMING METHOD OF IMAGE FORMING APPARATUS BASED ON SHEET SIZE

(71) Applicant: BROTHER KOGYO KABUSHIKI KAISHA, Nagoya, Aichi (JP)

(72) Inventor: Tomonori Watanabe, Ichinomiya (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 12 days.

(21) Appl. No.: 14/588,716

(22) Filed: Jan. 2, 2015

(65) Prior Publication Data

US 2015/0192888 A1 Jul. 9, 2015

(30) Foreign Application Priority Data

Jan. 8, 2014 (JP) ..... 2014-001905

(51) Int. Cl.
*G03G 15/23* (2006.01)
*G03G 15/00* (2006.01)

(52) U.S. Cl.
CPC ..... *G03G 15/6564* (2013.01); *G03G 15/234* (2013.01); *G03G 15/231* (2013.01); (Continued)

(58) Field of Classification Search
None
See application file for complete search history.

(56) References Cited

U.S. PATENT DOCUMENTS

2003/0095822 A1* 5/2003 Kamimura ..... G03G 15/6564 399/396
2009/0166963 A1 7/2009 Fukusawa
(Continued)

FOREIGN PATENT DOCUMENTS

JP H11100135 A 4/1999
JP 2006-143411 A 6/2006
(Continued)

OTHER PUBLICATIONS

Japanese Official Action dated Jul. 25, 2017 from related JP 2014-001905 together with English language translation.

*Primary Examiner* — Jennifer E Simmons
*Assistant Examiner* — Quang X Nguyen
(74) *Attorney, Agent, or Firm* — Scully, Scott, Murphy & Presser, P.C.

(57) ABSTRACT

An image forming apparatus including a first sensor configured to output a signal in response to detecting passage of each sheet fed by a sheet feeder, a second sensor configured to output a signal in response to detecting passage of each sheet re-conveyed by a re-conveyance unit, and a controller configured to acquire a passing time period during which a preceding sheet fed by the sheet feeder is passing through the first sensor, based on the signal from the first sensor, determine an adjustment time period between a time when a leading end of the preceding sheet re-conveyed by the re-conveyance unit is detected based on the signal from the second sensor and a time for the sheet feeder to feed a subsequent sheet toward the image forming unit, and control the sheet feeder to feed the subsequent sheet toward the image forming unit with timing adjusted based on the determined adjustment time period.

14 Claims, 7 Drawing Sheets

(52) U.S. Cl.
CPC ..... *G03G 15/6558* (2013.01); *G03G 2215/00556* (2013.01); *G03G 2215/00599* (2013.01); *G03G 2215/00734* (2013.01)

(56) References Cited

U.S. PATENT DOCUMENTS

| | | | | |
|---|---|---|---|---|
| 2011/0076076 | A1* | 3/2011 | Ban | G03G 15/234 399/364 |
| 2012/0056970 | A1 | 3/2012 | Miwa | |

FOREIGN PATENT DOCUMENTS

| | | | |
|---|---|---|---|
| JP | 2009-155039 | A | 7/2009 |
| JP | 2011-153028 | A | 8/2011 |
| JP | 2013-193828 | A | 9/2013 |

* cited by examiner

SHEET FEEDING TIMING METHOD OF IMAGE FORMING APPARATUS BASED ON SHEET SIZE

CROSS-REFERENCE TO RELATED APPLICATION

This application claims priority under 35 U.S.C. § 119 from Japanese Patent Application No. 2014-001905 filed on Jan. 8, 2014. The entire subject matter of the application is incorporated herein by reference.

BACKGROUND

Technical Field

The following description relates to one or more techniques to control a conveyance interval between successive two sheets of a plurality of sheets to be conveyed.

Related Art

An image forming apparatus has been known that is configured to control sheet feeding timing and narrow a conveyance interval between any successive two of a plurality of sheets to be conveyed, in order to increase the number of sheets with images formed thereon per unit time. Specifically, the image forming apparatus includes a sensor unit disposed at a feed tray. The sensor unit is configured to detect a size of sheets placed on the feed tray. In advance of starting image formation, the image forming apparatus updates the sheet feeding timing depending on a length of the sheets in a sheet conveyance direction, based on the size of the sheets detected by the sensor unit.

SUMMARY

The known image forming apparatus controls the sheet feeding timing for each sheet to be fed after starting the image formation, based on information on the size of the sheets detected by the sensor unit at the feed tray before starting the image formation. Therefore, when the information on the size of the sheets is not acquired, a problem is caused that the conveyance interval between successive two sheets might vary in every operation of feeding each of the plurality of sheets.

Further, an image forming apparatus has been known that is configured to perform duplex image formation. Specifically, the image forming apparatus is configured to perform image formation on a first side of a sheet by an image forming unit, and thereafter re-convey the sheet to the image forming unit via a re-conveyance unit to perform image formation on a second side of the sheet. Nevertheless, in the image forming apparatus configured to perform duplex image formation, any careful consideration on the following problem has not been made so far. The problem is that a conveyance interval between a preceding sheet to be re-conveyed to the image forming unit after the image forming unit completes image formation on a first side of the preceding sheet and a subsequent sheet varies depending on a difference in length in a sheet conveyance direction between the preceding sheet and the subsequent sheet.

Aspects of the present disclosure are advantageous to provide one or more improved techniques, for an image forming apparatus capable of duplex image formation, which make it possible to prevent a conveyance interval between a preceding sheet and a subsequent sheet from varying depending on a difference in length in a sheet conveyance direction between the preceding sheet and the subsequent sheet.

According to aspects of the present disclosure, an image forming apparatus is provided, which includes a sheet holder configured to hold one or more sheets, an image forming unit configured to perform image formation on the one or more sheets fed from the sheet holder, a sheet feeder configured to feed the one or more sheets held in the sheet holder toward the image forming unit, a re-conveyance unit configured to re-convey, toward the image forming unit, the one or more sheets having passed through the image forming unit, a first sensor configured to output a signal in response to detecting passage of each sheet fed by the sheet feeder, a second sensor configured to output a signal in response to detecting passage of each sheet re-conveyed by the re-conveyance unit, and a controller configured to acquire a passing time period during which a preceding sheet fed by the sheet feeder is passing through the first sensor, based on the signal from the first sensor, determine an adjustment time period between a time when a leading end of the preceding sheet re-conveyed by the re-conveyance unit is detected based on the signal from the second sensor and a time for the sheet feeder to feed a subsequent sheet toward the image forming unit, and control the sheet feeder to feed the subsequent sheet toward the image forming unit with timing adjusted based on the determined adjustment time period.

According to aspects of the present disclosure, further provided is a method adapted to be implemented on a processor coupled with an image forming apparatus including a sheet holder configured to hold one or more sheets, an image forming unit configured to perform image formation on the one or more sheets fed from the sheet holder, a sheet feeder configured to feed the one or more sheets held in the sheet holder toward the image forming unit, a re-conveyance unit configured to re-convey, toward the image forming unit, the one or more sheets having passed through the image forming unit, a first sensor configured to output a signal in response to detecting passage of each sheet fed by the sheet feeder, and a second sensor configured to output a signal in response to detecting passage of each sheet re-conveyed by the re-conveyance unit, the method including acquiring a passing time period during which a preceding sheet fed by the sheet feeder is passing through the first sensor, based on the signal from the first sensor, determining an adjustment time period between a time when a leading end of the preceding sheet re-conveyed by the re-conveyance unit is detected based on the signal from the second sensor and a time for the sheet feeder to feed a subsequent sheet toward the image forming unit, and feeding, by the sheet feeder, the subsequent sheet toward the image forming unit with timing adjusted based on the determined adjustment time period.

According to aspects of the present disclosure, further provided is a non-transitory computer-readable medium storing computer-readable instructions that are executable by a processor coupled with an image forming apparatus including a sheet holder configured to hold one or more sheets, an image forming unit configured to perform image formation on the one or more sheets fed from the sheet holder, a sheet feeder configured to feed the one or more sheets held in the sheet holder toward the image forming unit, a re-conveyance unit configured to re-convey, toward the image forming unit, the one or more sheets having passed through the image forming unit, a first sensor configured to output a signal in response to detecting passage of each sheet fed by the sheet feeder, and a second sensor configured to output a signal in response to detecting passage of each sheet re-conveyed by the re-conveyance unit, the instructions being configured to, when executed by the processor, cause the processor to acquire a passing time period during which a preceding sheet fed by the sheet feeder is passing through the first sensor, based on the signal from the first sensor, determine an adjustment time period between a time when a leading end of the preceding sheet re-conveyed by the re-conveyance unit is detected based on the signal from the second sensor and a time for the sheet feeder to feed a subsequent sheet toward the image forming unit, and control the sheet feeder to feed the subsequent sheet toward the image forming unit with timing adjusted based on the determined adjustment time period.

BRIEF DESCRIPTION OF THE ACCOMPANYING DRAWINGS

Figure 5A:
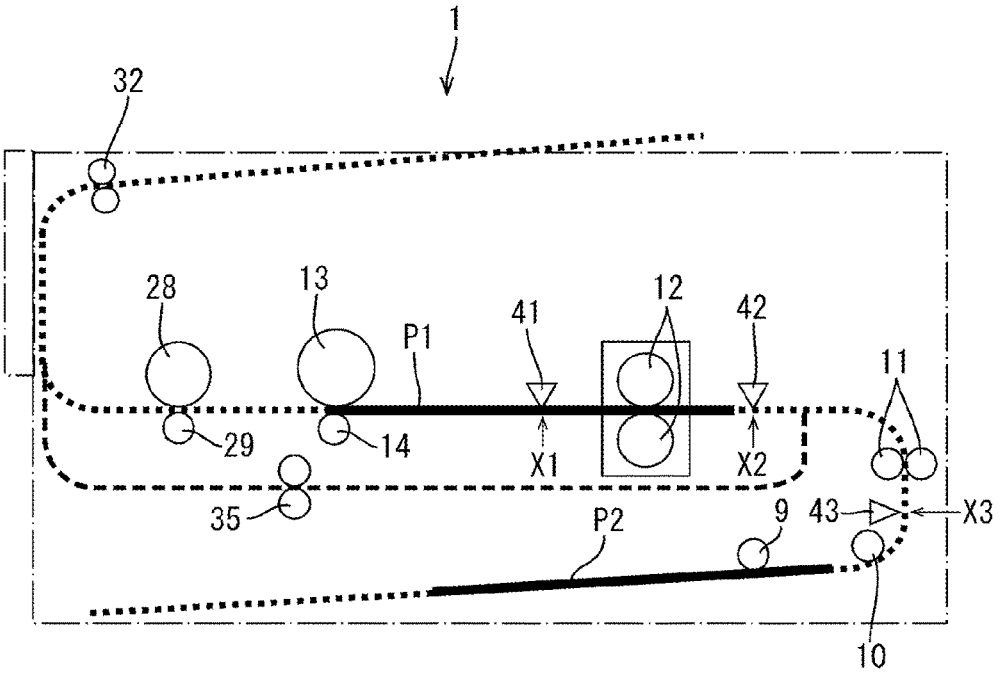

FIG. 5A exemplifies a state where the preceding sheet is fed onto a feeding path, and an image forming unit is beginning to perform image formation on a first side of the preceding sheet, in the illustrative embodiment according to one or more aspects of the present disclosure.

Figure 5B:
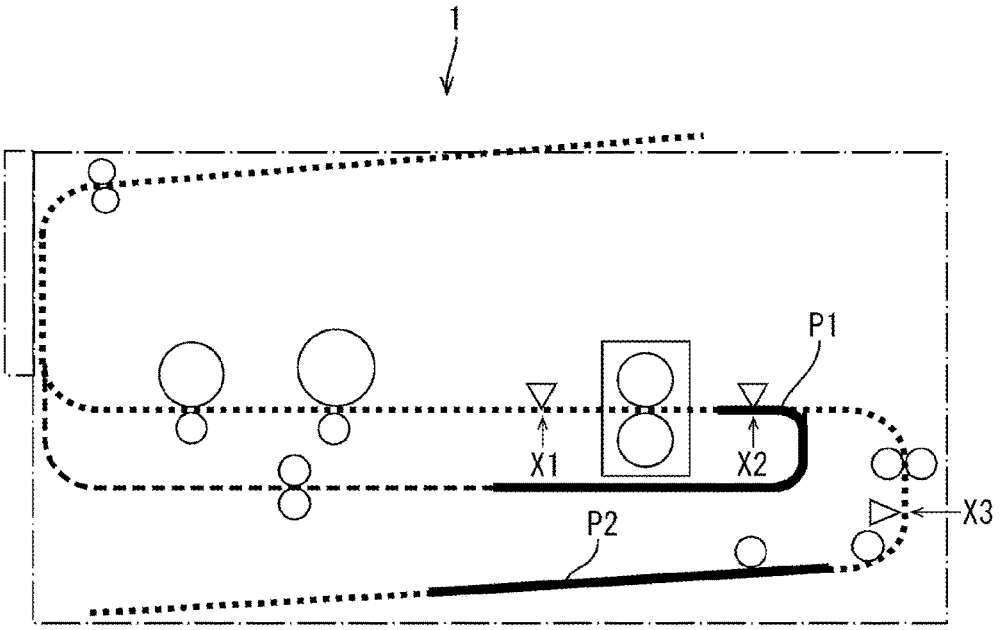

FIG. 5B exemplifies a state where a leading end of the preceding sheet has reached a position X2 via a turn-around path, and the subsequent sheet begins to be fed from a sheet holder, in the illustrative embodiment according to one or more aspects of the present disclosure.

Figure 5C:
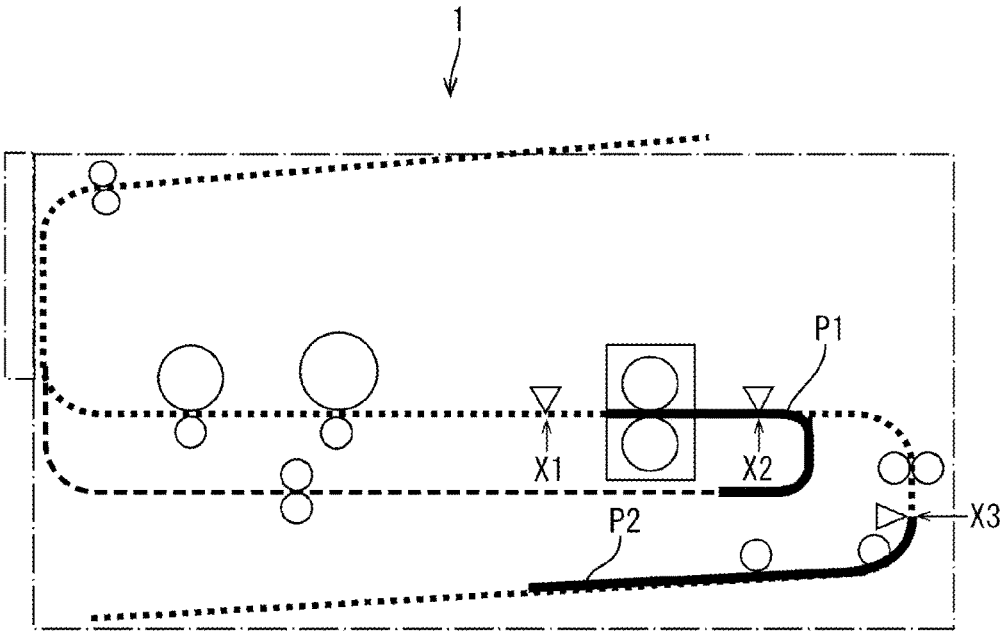

FIG. 5C exemplifies a state where a leading end of the subsequent sheet has reached a position X3, and the feeding of the subsequent sheet is halted, in the illustrative embodiment according to one or more aspects of the present disclosure.

Figure 5D:
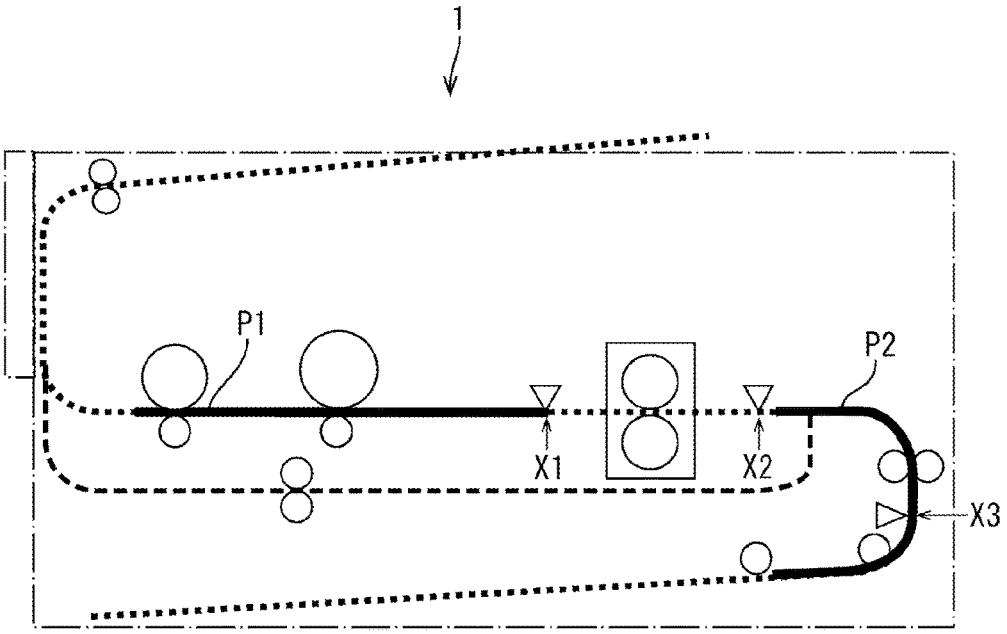

FIG. 5D exemplifies a state where the feeding of the subsequent sheet is resumed, in the illustrative embodiment according to one or more aspects of the present disclosure.

Figure 6:
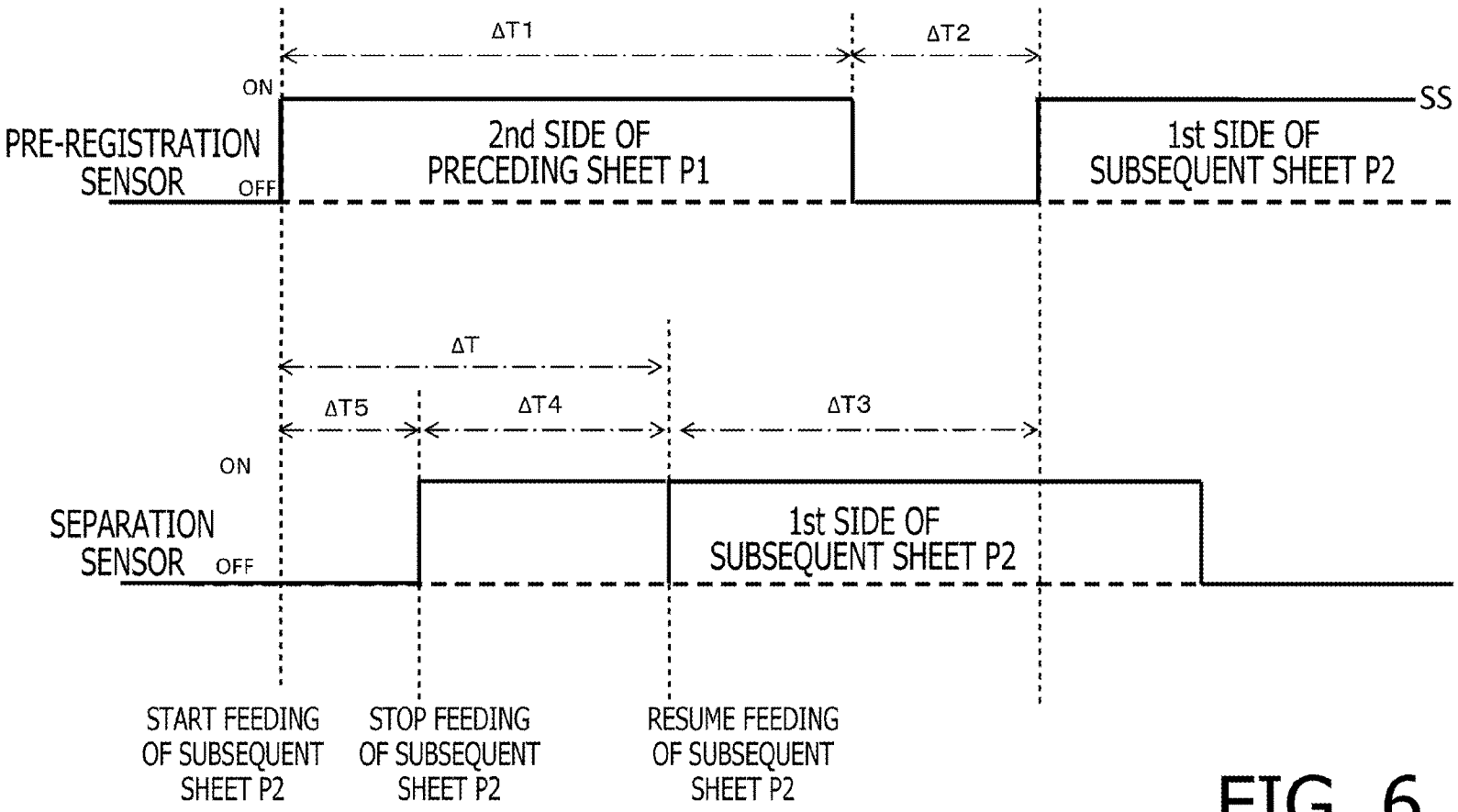

FIG. 6 is a timing chart that illustrates timing to begin to feed the subsequent sheet in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, a printer 1 of an illustrative embodiment according to aspects of the present disclosure will be described with reference to the accompanying drawings. In the following description, a right side in FIG. 1 will be defined as a front side F of the printer 1. A far side with respect to a paper surface of FIG. 1 will be defined as a right side R of the printer 1. Further, an upside of FIG. 1 will be defined as an upper side U of the printer 1.

The printer 1 is configured to perform image formation on one side or both sides of a recording sheet (hereinafter referred to as a sheet P). The printer 1 includes, in a main body housing 2, a sheet feeder 3, an image forming unit 4, and a re-conveyance unit 5.

The sheet feeder 3 is configured to feed sheets P to the image forming unit 4. The sheet feeder 3 includes a sheet holder 7 disposed at a lower portion of the main body housing 2. The sheet holder 7 is configured to hold and support sheets P such as papers and transparencies (OHP sheets) placed therein. The sheet feeder 3 includes a sheet feeding mechanism S and a guide portion 8A. The sheet feeding mechanism S is configured to feed the sheets P from the sheet holder 7. The guide portion 8A is configured to guide the sheets P to the image forming unit 4 along a feeding path 8. The sheet feeding mechanism S includes a pickup roller 9, a separation roller 10, feed rollers 11, and registration rollers 12. The pickup roller 9 is configured to contact a top one of the sheets P held in the sheet holder 7.

The sheets P held in the sheet holder 7 are pressed toward the pickup roller 9 by a sheet pressing plate 15, and picked up by the pickup roller 9. Then, the sheets P are separated on a sheet-by-sheet basis by the separation roller 10 and a separation pad 16. Thereafter, the sheets P are fed to the image forming unit 4 by the feed rollers 11 and the registration rollers 12.

The feed rollers 11 are disposed between the separation roller 10 and the registration rollers 12. The registration rollers 12 are disposed between the feed rollers 11 and a photoconductive drum 13.

The guide portion 8A is configured to contact a sheet being conveyed, and guide the sheet to be fed along the feeding path 8.

The pickup roller 9, the separation roller 10, the feed rollers 11, and the registration rollers 12 are driven by a single motor, and are controlled to rotate or stop by a clutch mechanism. Alternatively, the pickup roller 9, the separation roller 10, the feed rollers 11, and the registration rollers 12 may independently be driven by respective different motors. The registration rollers 12 may be replaced with normal feed rollers.

Figure 1:
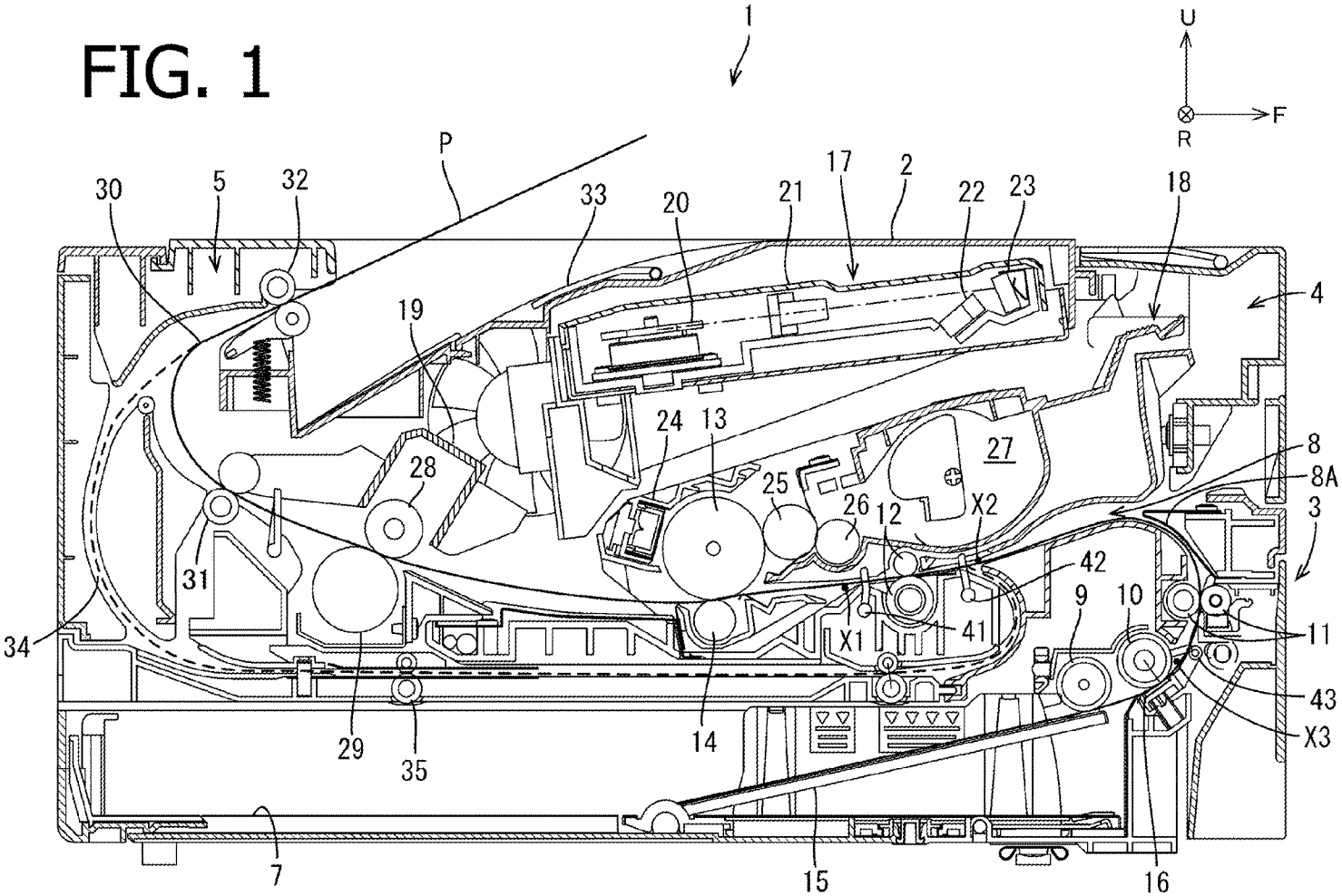
FIG. 1 is a cross-sectional side view showing an image forming apparatus in an illustrative embodiment according to one or more aspects of the present disclosure.

As indicated by a solid line in FIG. 1, the feeding path 8 is configured to guide the sheets P fed from the pickup roller 9, toward the image forming unit 4. The feeding path 8 extends obliquely toward an upper front side from around the sheet holder 7. Then, the feeding path 8 is curved while gradually changing its orientation to a rearward direction. Thereafter, the feeding path 8 extends toward the photoconductive drum 13 and a transfer roller 14.

The printer 1 further includes a post-registration sensor 41, a pre-registration sensor 42, and a separation sensor 43. The post-registration sensor 41 is disposed between the registration rollers 12 and the photoconductive drum 13. The post-registration sensor 41 is configured to output a signal in response to a sheet P passing through the post-registration sensor 41. Specifically, the post-registration sensor 41 is configured to issue a signal that indicates whether there is a sheet P in a position X1 between the registration rollers 12 and the photoconductive drum 13.

For example, the post-registration sensor 41 includes an actuator and an optical sensor. The actuator is configured to swing in response to contact with a sheet P. The optical sensor is configured to detect a swing motion of the actuator.

The pre-registration sensor 42 is disposed between the feed rollers 11 and the registration rollers 12. The pre-registration sensor 42 is configured to output a signal in response to a sheet P passing through the pre-registration sensor 42. Specifically, the pre-registration sensor 42 is configured to issue a signal that indicates whether there is a sheet P in a position X2 between the feed rollers 11 and the registration rollers 12. Timing for beginning to rotate the registration rollers 12 is determined based on a signal output from the pre-registration sensor 42 in response to a leading end of a sheet passing through the pre-registration sensor 42.

The separation sensor 43 is disposed between the separation roller 10 and the feed rollers 11. The separation sensor 43 is configured to output a signal in response to a sheet P fed from the sheet holder 7 passing through the separation sensor 43. Specifically, the separation sensor 43 is configured to issue a signal that indicates whether there is a sheet P in a position X3 between the separation roller 10 and the feed rollers 11.

The image forming unit 4 includes an exposure unit 17, a process cartridge 18, and a fuser unit 19.

The exposure unit 17 is disposed above the process cartridge 18. The exposure unit 17 is configured to scan a surface of the photoconductive drum 13 with a laser beam (indicated by an alternate long and short dashes line in FIG. 1) emitted by a laser emitting unit, based on image data. The laser beam emitted by the laser emitting unit is introduced onto the surface of the photoconductive drum 13, via a plurality of optical elements such as a rotating polygon mirror 20, a lens 21, a reflecting mirror 23, and a lens 22 in the aforementioned order.

The process cartridge 18 includes the photoconductive drum 13, a charger 24, the transfer roller 14, a development roller 25, a supply roller 26, and a toner container 27 configured to store toner (developer).

In the image forming unit 4, the surface of the photoconductive drum 13 is evenly charged by the charger 24, and then exposed to and scanned with the laser beam from the exposure unit 17. Thereby, an electrostatic latent image is formed on the photoconductive drum 13.

Afterward, when toner carried on the development roller 25 is supplied to the electrostatic latent image on the photoconductive drum 13, the electrostatic latent image is visualized, and a toner image is formed on the photoconductive drum 13. Thereafter, when a sheet P fed from the sheet feeder 3 is conveyed between the photoconductive drum 13 and the transfer roller 14, the toner image on the photoconductive drum 13 is transferred onto the sheet P. Subsequently, when the sheet P is conveyed between a heating roller 28 and a pressing roller of the fuser unit 19, the toner image transferred onto the sheet P is thermally fixed. The fuser unit 19 is disposed downstream relative to the process cartridge 18 in a sheet conveyance direction.

The re-conveyance unit 5 includes a feed roller 31 and a discharge roller 32. The feed roller 31 and the discharge roller 32 are configured to convey the sheet P with an image formed thereon by the toner image thermally fixed, along a discharge path 30, outside from the main body housing 2. The re-conveyance unit 5 further includes a re-conveyance roller 35. The re-conveyance roller 35 is configured to turn the sides of the sheet P around and re-convey the sheet P toward the image forming unit 4 along a turn-around path 34.

The discharge path 30 extends obliquely toward an upper rear side from around an exit of the fuser unit 19. Then, the discharge path 30 is curved while gradually changing its orientation to a frontward direction. Thereafter, the discharge path 30 extends toward a catch tray 33 disposed on an upper surface of the main body housing 2.

The discharge roller 32 is configured to rotate in a forward direction for conveying the sheet P outside from the main body housing 2 and a backward direction for conveying the sheet P to the turn-around path 34.

As indicated by the solid line in FIG. 1, the sheet P fed from the image forming unit 4 after image formation on the sheet P is conveyed along the discharge path 30 by the feed roller 31. When simplex image formation or duplex image formation on the sheet P is completed, the sheet P is discharged onto the catch tray 33 disposed on the upper surface of the main body housing 2, by the discharge roller 32 rotating in the forward direction. Meanwhile, when image formation is to be performed on a second side of the sheet P after completion of image formation on a first side of the sheet P, the sheet P is conveyed to a position where a trailing end of the sheet P is pinched between the discharge roller 32 and a pinch roller disposed to face the discharge roller 32, by the discharge roller 32 rotating in the forward direction. Thereafter, the sheet P is again pulled into the main body housing 2 and conveyed to the turn-around path 34 (see a dashed line in FIG. 1) by the discharge roller 32 rotating in the backward direction.

The turn-around path 34 diverges from the discharge path 30 such that the sheet P fed by the discharge roller 32 rotating in the backward direction is introduced onto the turn-around path 34, and extends substantially downward. Then, the turn-around path 34 is curved while gradually changing its orientation to a frontward direction, and passes between the sheet holder 7 and the image forming unit 4. Thereafter, the turn-around path 34 is curved while gradually changing its orientation to an upward direction, and joins the feeding path 8 at an upstream side relative to the registration rollers 12 in the sheet conveyance direction.

Therefore, the sheet P fed by the discharge roller 32 rotating in the backward direction is conveyed from the turn-around path 34 to the feeding path 8, with the sides of the sheet P being turned around, and then fed to the image forming unit 4. Thereafter, an image is formed on the second side of the sheet P by the image forming unit 4, and the sheet P is discharged onto the catch tray 33.

Figure 2:
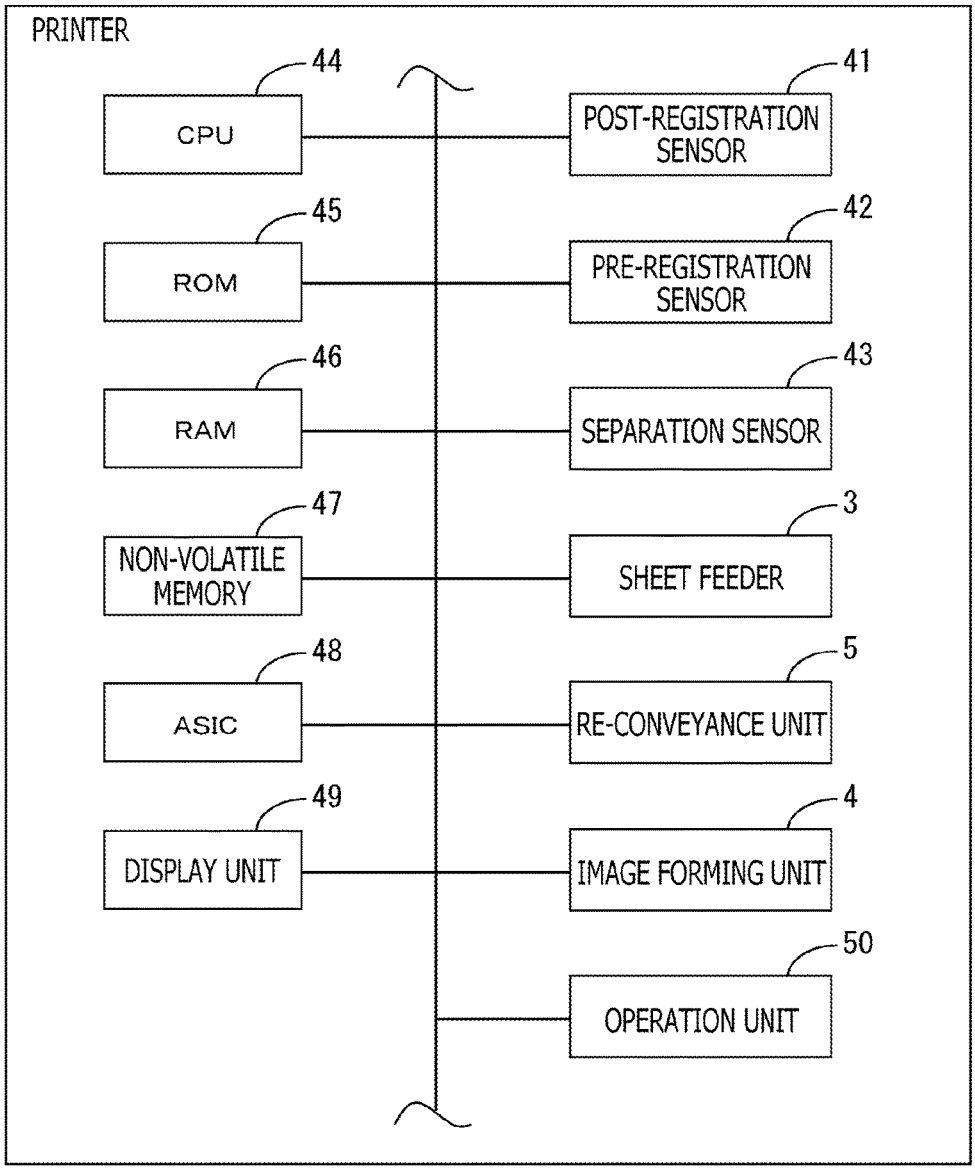
FIG. 2 is a block diagram showing an electrical configuration of the image forming apparatus in the illustrative embodiment according to one or more aspects of the present disclosure.

As shown in FIG. 2, the printer 1 includes a central processing unit 44 (hereinafter referred to as a CPU 44 in an abbreviated form), a read-only memory 45 (hereinafter referred to as a ROM 45 in an abbreviated form), a random access memory 46 (hereinafter referred to as a RAM 46 in an abbreviated form), a non-volatile memory 47, an application specific integrated circuit 48 (hereinafter referred to as an ASIC 48 in an abbreviated form), a display unit 49, and an operation unit 50, as well as the aforementioned sheet feeder 3, the aforementioned image forming unit 4, and the aforementioned re-conveyance unit 5.

The ROM 45 is configured to store various programs. The various programs contain a program for executing a below-mentioned image forming process, and programs for controlling operations of elements (such as the image forming unit 4) included in the printer 1. The RAM 46 is utilized as a work area for the CPU 44 to execute the various programs, and utilized as a memory area for temporarily storing data.

The non-volatile memory 47 is configured to previously store regular sizes of the sheets P such as an A4 size, a letter size, and a legal size. The non-volatile memory 47 may be any storage device configured to maintain data stored therein, even though an electrical supply thereto is interrupted. As the non-volatile memory 47, exemplified are a non-volatile random access memory (hereinafter referred to as an NVRAM in an abbreviated form), a flash memory, a hard disk drive (hereinafter referred to as an HDD in an abbreviated form), and an electrically erasable programmable read-only memory (hereinafter referred to as an EEPROM in an abbreviated form).

The CPU 44 is connected with the ROM 45 and the RAM 46. The CPU 44 is configured to control each of elements included in the printer 1 in accordance with programs read out of the ROM 45.

Further, the printer 1 includes the display unit 49 and the operation unit 50. The display unit 49 includes a liquid crystal display device and lamps. The display unit 49 is configured to display various setting screens and operational states of the printer 1. The operation unit 50 includes a plurality of buttons. The operation unit 50 is configured to accept various instructions from a user.

Figure 3:
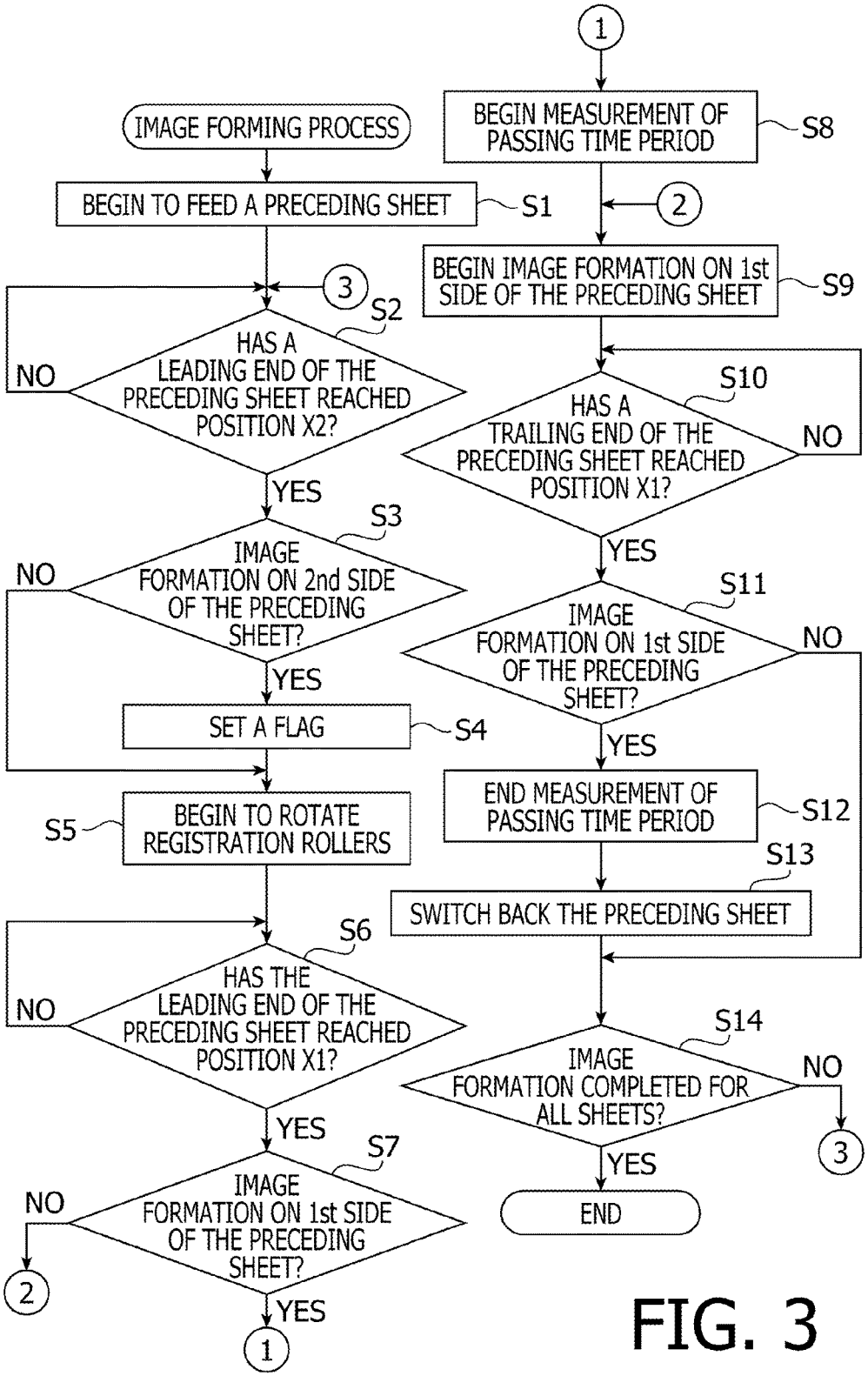
FIG. 3 is a flowchart showing a procedure of an image forming process by the image forming apparatus in the illustrative embodiment according to one or more aspects of the present disclosure.

As shown in FIG. 3, when the user operates a personal computer or the operation unit 50, and thereby, a print job is input into the printer 1, the CPU 44 drives the pickup roller 10, the separation roller 10, and the feed rollers 11 to begin to feed a first sheet (a preceding sheet) P1 (S1).

The CPU 11 drives the pickup roller 9 and the separation roller 10 for a predetermined time period, and then stops driving the pickup roller 9 and the separation roller 10. Meanwhile, the CPU 11 continues to drive the feed rollers 11. The pickup roller 9 and the separation roller 10, each of which has a one-way clutch, rotate along with the sheet P being conveyed by the feed rollers 11, even after the driving of the pickup roller 9 and the separation roller 10 has been halted.

The CPU 44 determines whether a leading end of the preceding sheet P1 has reached the position X2 (S2). When determining that the leading end of the preceding sheet P1 has not reached the position X2 (S2: No), the CPU 44 continues to feed the preceding sheet P1. Meanwhile, when determining that the leading end of the preceding sheet P1 has reached the position X2 (S2: Yes), the CPU 44 determines whether the image forming unit 4 is about to perform image formation on a second side of the preceding sheet P1 (S3). It is noted that, in the illustrative embodiment, a downward-facing side and an upward-facing side of each sheet P held in the sheet holder 7 are defined as a second side and a first side, respectively.

When determining that the image forming unit 4 is about to perform image formation on the second side of the preceding sheet P1 (S3: Yes), the CPU 44 sets a flag and stores the flag into the RAM 46 (S4). Meanwhile, when determining that the image forming unit 4 is not about to perform image formation on the second side of the preceding sheet P1 (S3: No), the CPU 44 goes to S5.

After a predetermined time period has elapsed since the determination that the leading end of the preceding sheet P1 has reached the position X2, the CPU 44 begins to rotate the registration rollers 12 (S5). Since the CPU 44 begins to rotate the registration rollers 12 after determining that the predetermined time period has elapsed, the preceding sheet P1 comes into contact with the registration rollers 12, such that the leading end of the preceding sheet P1 is restricted from moving. Then, after skew correction for the preceding sheet P1 is performed by the registration rollers 12, the preceding sheet P1 is fed to a position between the photoconductive drum 13 and the transfer roller 14 by rotation of the registration rollers 12.

Subsequently, the CPU 44 determines whether the leading end of the preceding sheet P1 has reached the position X1 (S6). When determining that the leading end of the preceding sheet P1 has not reached the position X1 (S6: No), the CPU 44 continues to feed the preceding sheet P1. Meanwhile, when determining that the leading end of the preceding sheet P1 has reached the position X1 (S6: Yes), the CPU 44 determines whether the image forming unit 4 is about to perform image formation on the first side of the preceding sheet P1 (S7).

When determining that the image forming unit 4 is about to perform image formation on the first side of the preceding sheet P1 (S7: Yes), the CPU 44 begins to measure a passing time period between a starting time point at which the leading end of the preceding sheet P1 reaches the position X1 and an end time point at which the trailing end of the preceding sheet P1 reaches the position X1 (i.e., the passing time period is a time period during which the preceding sheet P1 is passing through the post-registration sensor 41) (S8). Thereafter, the CPU 44 begins to perform image formation on the first side of the preceding sheet P1 (S9).

Meanwhile, when determining that the image forming unit 4 is not about to perform image formation on the first side of the preceding sheet P1 (S7: No), the CPU 44 goes to S9.

FIG. 5A exemplifies a state where the preceding sheet P1 is fed onto the feeding path 8, and the image forming unit 4 is beginning to perform image formation. In FIG. 5A, the leading end of the preceding sheet P1 has passed through the position X1, and the CPU 44 is still measuring the passing time period from the starting time point at which the leading end of the preceding sheet P1 has reached the position X1.

Subsequently, the CPU 44 determines whether the trailing end of the preceding sheet P1 has reached the position X1 (S10). When determining that the trailing end of the preceding sheet P1 has not reached the position X1 (S10: No), the CPU 44 continues to feed the preceding sheet P1.

Meanwhile, when determining that the trailing end of the preceding sheet P1 has reached the position X1 (S10: Yes), the CPU 44 determines whether the image forming unit 4 is about to perform image formation on the first side of the preceding sheet P1 (S11).

When determining that the image forming unit 4 is about to perform image formation on the first side of the preceding sheet P1 (S11: Yes), the CPU 44 ends the measurement of the passing time period (S12). Specifically, the CPU 44 acquires a time period $\Delta T1$ between a time when the leading end of the preceding sheet P1 has reached the position X1 and a time when the trailing end of the preceding sheet P1 has reached the position X1, and stores the acquired time period $\Delta T1$ into the RAM 46.

When causing the image forming unit 4 to perform image formation on the preceding sheet P1, the CPU 44 controls the registration rollers 12 to rotate at a predetermined constant rotational speed stored in the ROM 45. Therefore, the preceding sheet P1 is conveyed at a constant conveyance velocity.

Thereafter, the CPU 44 switches back the preceding sheet P1 (S13). Meanwhile, when determining that the image forming unit 4 is not about to perform image formation on the first side of the preceding sheet P1 (S11: No), the CPU 44 goes to S14.

In S14, the CPU 44 determines whether image formation has been completed for all the sheets P (S14). When determining that image formation has not been completed for all the sheets P (S14: No), the CPU 44 goes back to S2 to perform image formation on a next sheet P.

Meanwhile, when determining that image formation has been completed for all the sheets P (S14: Yes), the CPU 44 terminates the image forming process.

Figure 4:
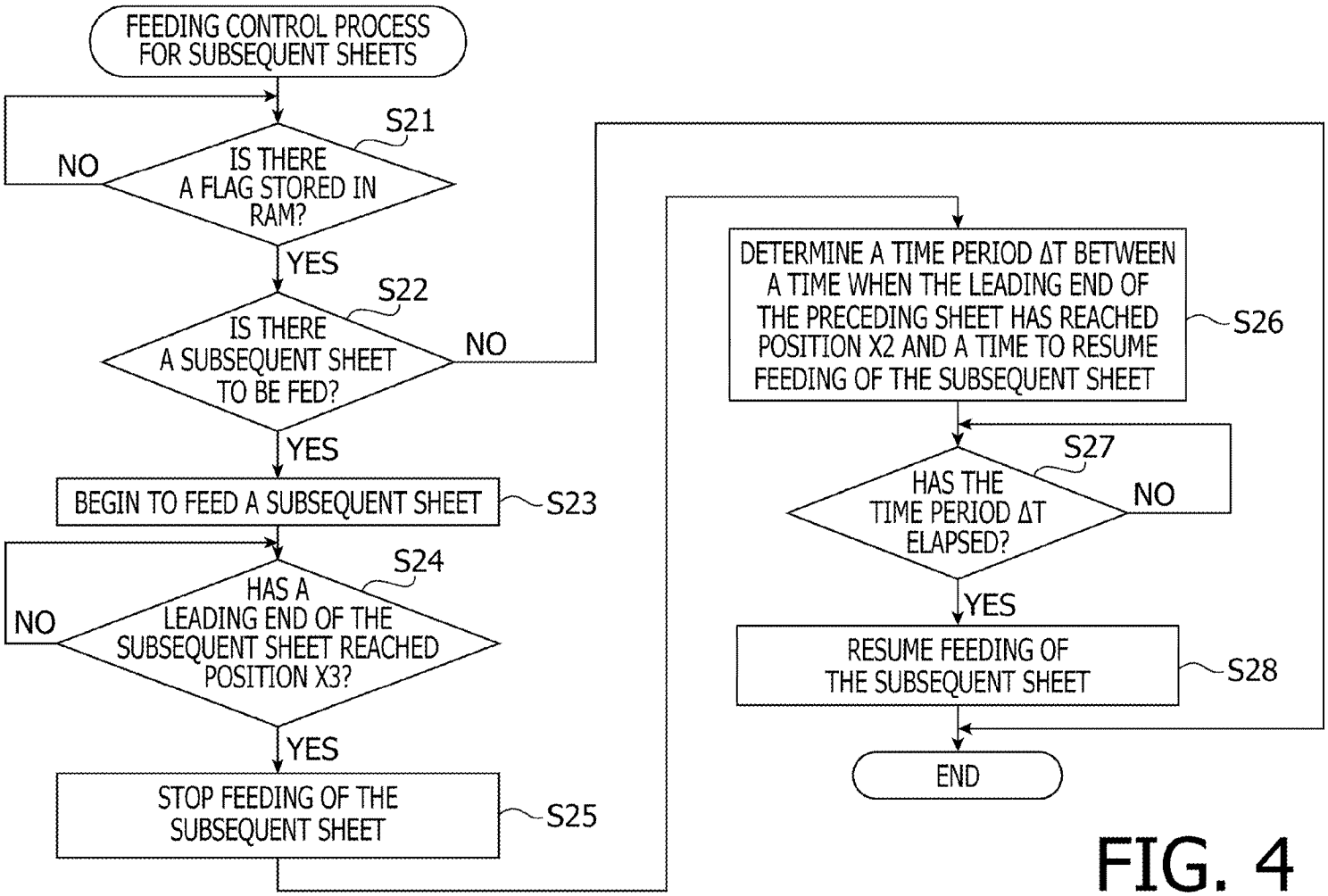
FIG. 4 is a flowchart showing a procedure of a feeding control process by the image forming apparatus for controlling feeding of a subsequent sheet to be fed following a preceding sheet, in the illustrative embodiment according to one or more aspects of the present disclosure.

As shown in FIG. 4, the CPU 44 performs a feeding control process for subsequent sheets P2, in parallel with the aforementioned image forming process. In the feeding control process, firstly, the CPU 44 determines whether the flag set in S4 is stored in the RAM 46 (S21).

When determining that the flag is not stored in the RAM 46 (S21: No), the CPU 44 waits for the flag to be set and stored in the RAM 46. Meanwhile, when determining that the flag is stored in the RAM 46 (S21: Yes), the CPU 44 determines whether there is a subsequent sheet P2 to be fed, in the sheet holder 7 (S22).

When determining that there is not a subsequent sheet P2 to be fed, in the sheet holder 7 (S22: No), the CPU 44 terminates the feeding control process for the subsequent sheets S2. Meanwhile, when determining that there is a subsequent sheet P2 to be fed, in the sheet holder 7 (S22: Yes), the CPU 44 drives the pickup roller 9 and the separation roller 10, and begins to feed a subsequent sheet P2 (S23).

FIG. 5B exemplifies a state where the CPU 44 is beginning to feed a subsequent sheet P2 held in the sheet holder 7 in response to the CPU 44 determining that the leading end of the preceding sheet P1 has reached the position X2 (S2: Yes) and that the image forming unit 4 is about to perform image formation on the second side of the preceding sheet P1 (S3: Yes).

Next, the CPU 44 determines whether a leading end of the subsequent sheet P2 has reached the position X3 (S24).

When determining that the leading end of the subsequent sheet P2 has not reached the position X3 (S24: No), the CPU 44 continues to feed the subsequent sheet P2. Meanwhile, when determining that the leading end of the subsequent sheet P2 has reached the position X3 (S24: Yes), the CPU 44 stops the feeding of the subsequent sheet P2 and causes the separation roller 10 to hold the subsequent sheet P2 (S25).

FIG. 5C exemplifies a state where the CPU 44 stops the feeding of the subsequent sheet P2 and causes the separation roller 10 to hold the subsequent sheet P2 (S25) in response to the CPU 44 determining that the leading end of the subsequent sheet P2 has reached the position X3 (S24: Yes). The CPU 44 causes the separation roller 10 to hold the subsequent sheet P2 and makes the subsequent sheet P2 stand by.

The CPU 44 determines an adjustment time period ΔT between a time when the leading end of the preceding sheet P1 has reached the position X2 and a time to resume the feeding of the subsequent sheet P2, based on the time period ΔT1 stored in the RAM 46 (S26).

When determining that the adjustment time period ΔT has not elapsed since the leading end of the preceding sheet P1 reached the position X2 (S27: No), the CPU 44 waits until the adjustment time period ΔT has elapsed. Meanwhile, when determining that the adjustment time period ΔT has elapsed since the leading end of the preceding sheet P1 reached the position X2 (S27: Yes), the CPU 44 resumes the feeding of the subsequent sheet P2 (S28). Thereafter, the CPU 44 terminates the feeding control process.

FIG. 5D exemplifies a state where the CPU 44 resumes the feeding of the subsequent sheet P2 (S28) in response to the CPU 44 determining that the adjustment time period ΔT has elapsed since the leading end of the preceding sheet P1 reached the position X2 (S27: Yes).

FIG. 6 is a timing chart showing when the pre-registration sensor 42 and the separation sensor 43 are set ON and OFF within a time period from the state shown in FIG. 5B to the state shown in FIG. 5D. It is noted that, in the timing chart, a moment at which an output signal from a sensor changes from an OFF-state to an ON-state represents a moment at which a leading end of a sheet P reaches a position of the sensor. In addition, a moment at which the output signal from the sensor changes from the ON-state to the OFF-state represents a moment at which a trailing end of the sheet P reaches the position of the sensor. Further, each roller is rotating at a constant rotational speed.

A length of the preceding sheet P1 in the sheet conveyance direction does not vary with a lapse of time. Therefore, a time period ΔT1 between a time when the pre-registration sensor 42 is set ON and a time when the pre-registration sensor 42 is set OFF is equivalent to the time period ΔT1 measured in the image formation on the first side of the preceding sheet P1. Further, since an interval between the preceding sheet P1 and the subsequent sheet P2 is to be constant, a time period ΔT2 is set to a constant value. It is noted that the time period ΔT2 is a period between a time when the trailing end of the preceding sheet P1 reaches the position X2, and the pre-registration sensor 42 is set OFF, and a time when the leading end of the subsequent sheet P2 reaches the position X2, and the pre-registration sensor 42 is set ON.

Further, a distance between the separation sensor 43 and the pre-registration sensor 42 is constant. Therefore, a time period ΔT3 is constant. It is noted that the time period ΔT3 is a period required to convey a sheet P from the position X3 corresponding to the separation sensor 43 to the position X2 corresponding to the pre-registration sensor 42 is constant.

A time period ΔT5 may vary. It is noted that the time period ΔT5 is a period between a time when the feeding of the subsequent sheet P2 is started and a time when the leading end of the subsequent sheet P2 reaches the position X3, and the separation sensor 43 is set ON. This is because a situation where one or more sheets P are inserted between the separation roller 10 and the separation pad 16 differs in every operation of feeding each of the sheets P. Furthermore, a frictional force between the pickup roller 9 and a surface of each sheet P differs in every operation of feeding each of the sheets P.

The adjustment time period ΔT between the time when the pre-registration sensor 42 is set ON and the time to resume the feeding of the subsequent sheet P2 is determined to be a value derived from an expression "ΔT=ΔT1+ΔT2−ΔT3." Even when the time period ΔT5 varies, the time period ΔT4 varies depending on the time period ΔT5.

Accordingly, even though the situation where one or more sheets P are inserted between the separation roller 10 and the separation pad 16 and/or a frictional force between the pickup roller 9 and the surface of each sheet P differs in every operation of feeding the sheets P, the CPU 44 is allowed to make constant the interval between the preceding sheet P1 and the subsequent sheet P2. Namely, the shorter the length of the preceding sheet P1 in the sheet conveyance direction is, the shorter the adjustment time period ΔT is determined. Since the time period ΔT2 is constant, the interval between the preceding sheet P1 and the subsequent sheet P2 is rendered constant.

Advantageous Effects

According to the illustrative embodiment, when determining that the leading end of the subsequent sheet P2 has reached the position X3 (S24: Yes), the CPU 44 halts the feeding of the subsequent sheet P2, and causes the separation roller 10 to hold the subsequent sheet P2 (S25). Hence, even though the situation where one or more sheets P are inserted between the separation roller 10 and the separation pad 16 and/or a frictional force between the pickup roller 9 and the surface of each sheet P differs in every operation of feeding the sheets P, the CPU 44 is allowed to make constant the interval between the preceding sheet P1 and the subsequent sheet P2.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

Modification

In the aforementioned illustrative embodiment, the printer 1 includes the single CPU 44 and the storage devices such as the ROM 45, the RAM 46, and the non-volatile memory 47. Nevertheless, the printer 1 may include two or more CPUs. Alternatively, the printer 1 may include one or more hardware circuits such as ASICs, instead of the CPU 44. Furthermore, the printer 1 may include one or more CPUs and one or more hardware circuits, as well as the CPU 44 and the ASIC 48.

In the aforementioned illustrative embodiment, the RAM 46 is exemplified as a storage medium storing the various programs. Nevertheless, besides the RAM 46, non-volatile memories may be employed such as a CD-ROM, an HDD, and a flash memory.

The aforementioned illustrative embodiment provides an example in which the CPU 44 resumes the feeding of the subsequent sheet P2 based on the passing time period between the time when the leading end of the preceding sheet P1 reaches the position X2 and the time when the trailing end of the preceding sheet P1 reaches the position X2. Nevertheless, the CPU 44 may be configured to detect a length of the preceding sheet P1 in the sheet conveyance direction, and resume the feeding of the subsequent sheet P2 based on the detected length of the preceding sheet P1 in the sheet conveyance direction. Further, based on the detection result, the CPU 44 may select the length of the preceding sheet P1 in the sheet conveyance direction from among the regular sizes of the sheets P stored in the non-volatile memory 47.

The post-registration sensor 41 and the pre-registration sensor 42 may be different sensors or the same sensor.

In the aforementioned illustrative embodiment, papers and transparencies (OHP sheets) are exemplified as the sheets P. Nevertheless, the sheets P may be other media such as cloth sheets or films.

The aforementioned illustrative embodiment provides an example in which the CPU 44 begins to feed the subsequent sheet P2 in response to determining that the leading end of the preceding sheet P1 has reached the position X2. Nevertheless, the CPU 44 may be configured to start feeding the subsequent sheet P2 in response to determining that the discharge roller 32 is rotated in the backward direction to switch back the preceding sheet P1.

The aforementioned illustrative embodiment provides an example in which the post-registration sensor 41 is configured to issue signals in response to a leading end and a trailing end of a sheet P in the conveyance direction passing through the post-registration sensor 41. Nevertheless, the post-registration sensor 41 may concurrently serve as a sensor for controlling laser emission timing of the laser emitting unit of the exposure unit 17.

What is claimed is:

1. An image forming apparatus comprising:

a sheet holder configured to hold one or more sheets;

an image forming unit configured to perform image formation on the one or more sheets fed from the sheet holder;

a sheet feeder configured to feed the one or more sheets held in the sheet holder in a sheet conveyance direction toward the image forming unit;

a re-conveyance unit configured to re-convey, toward the image forming unit, the one or more sheets having passed through the image forming unit;

a first sensor configured to output a signal in response to detecting passage of each sheet fed by the sheet feeder;

a second sensor configured to output a signal in response to detecting passage of each sheet re-conveyed by the re-conveyance unit, the second sensor being located upstream of the first sensor;

a third sensor configured to output a signal in response to detecting passage of each sheet fed by the sheet feeder, the third sensor being located upstream of the second sensor; and a controller configured to:

begin to feed a preceding sheet by the sheet feeder;

acquire a passing time period during which the preceding sheet being fed by the sheet feeder is passing through the first sensor, based on the signal from the first sensor;

begin to re-convey the preceding sheet by the re-conveyance unit;

begin to feed a subsequent sheet in response to the leading end of the preceding sheet being detected by the second sensor;

stop feeding the subsequent sheet at a predetermined position downstream of the sheet holder in the sheet conveyance direction in response to the leading end of the subsequent sheet being detected by the third sensor, the third sensor being located at the predetermined position;

in response to feeding of the subsequent sheet being stopped at the predetermined position after the preceding sheet has begun to be re-conveyed by the re-conveyance unit, calculate, based on the acquired passing time period during which the preceding sheet was passing through the first sensor, an adjustment time period between a point of time when a leading end of the preceding sheet re-conveyed by the re-conveyance unit is detected based on the signal from the second sensor and a point of time when the subsequent sheet is to resume being fed from the predetermined position toward the image forming unit, by the sheet feeder, the adjustment time period being determined to be shorter as the acquired passing time period is shorter; and control the sheet feeder to feed the subsequent sheet from the predetermined position toward the image forming unit with timing adjusted based on the calculated adjustment time period.

2. The image forming apparatus according to claim 1, wherein the sheet feeder comprises a separator configured to separate a plurality of sheets fed from the sheet holder, on a sheet-by-sheet basis, and wherein the controller is configured to control the sheet feeder to, after feeding the subsequent sheet from the sheet holder, stop the feeding of the subsequent sheet when a leading end of the subsequent sheet is positioned between the separator and the image forming unit.

3. The image forming apparatus according to claim 1, wherein the controller is configured to control the image forming unit to start image formation on each sheet based on the signal from the first sensor.

4. The image forming apparatus according to claim 1, further comprising a registration unit configured to perform skew correction for each sheet to be fed to the image forming unit, wherein the registration unit is disposed between the sheet feeder and the image forming unit in a sheet conveyance direction from the sheet holder toward the image forming unit, and disposed between the re-conveyance unit and the image forming unit in a sheet re-conveyance direction from the re-conveyance unit toward the image forming unit.

5. The image forming apparatus according to claim 4, wherein the first sensor is disposed between the registration unit and the image forming unit in the sheet conveyance direction.

6. The image forming apparatus according to claim 4, wherein the second sensor is disposed between the sheet feeder and the registration unit in the sheet conveyance direction.

7. The image forming apparatus of claim 1, wherein the point of time when the subsequent sheet is to resume being fed from the predetermined position toward the image forming unit is the acquired passing time period, plus a time interval between the preceding sheet and the subsequent sheet passing the second sensor, less a time period to convey a sheet from the third sensor to the second sensor.

8. A method adapted to be implemented on a processor coupled with an image forming apparatus comprising:

a sheet holder configured to hold one or more sheets;

an image forming unit configured to perform image formation on the one or more sheets fed from the sheet holder;

a sheet feeder configured to feed the one or more sheets held in the sheet holder in a sheet conveyance direction toward the image forming unit;

a re-conveyance unit configured to re-convey, toward the image forming unit, the one or more sheets having passed through the image forming unit;

a first sensor configured to output a signal in response to detecting passage of each sheet fed by the sheet feeder; and a second sensor configured to output a signal in response to detecting passage of each sheet re-conveyed by the re-conveyance unit, the second sensor being located upstream of the first sensor;

a third sensor configured to output a signal in response to detecting passage of each sheet fed by the sheet feeder the third sensor being located upstream of the second sensor, the method comprising:

beginning to feed a preceding sheet by the sheet feeder;

acquiring a passing time period during which the preceding sheet being fed by the sheet feeder is passing through the first sensor, based on the signal from the first sensor;

beginning to re-convey the preceding sheet by the re-conveyance unit;

beginning to feed a subsequent sheet in response to the leading end of the preceding sheet being detected by the second sensor;

stopping to feed the subsequent sheet at a predetermined position downstream of the sheet holder in the sheet conveyance direction in response to the leading end of the subsequent sheet being detected by a third sensor, the third sensor being located at the predetermined position;

in response to feeding of the subsequent sheet being set in the predetermined position after the preceding sheet has begun to be re-conveyed by the re-conveyance unit, calculating, based on the acquired passing time period during which the preceding sheet was passing through the first sensor, an adjustment time period between a point of time when a leading end of the preceding sheet re-conveyed by the re-conveyance unit is detected based on the signal from the second sensor and a point of time when the subsequent sheet is to resume being fed from the predetermined position toward the image forming unit by the sheet feeder, the adjustment time period being determined to be shorter as the acquired passing time period is shorter; and feeding, by the sheet feeder, the subsequent sheet from the predetermined position toward the image forming unit with timing adjusted based on the calculated adjustment time period.

9. A non-transitory computer-readable medium storing computer-readable instructions that are executable by a processor coupled with an image forming apparatus comprising:

a sheet holder configured to hold one or more sheets;

an image forming unit configured to perform image formation on the one or more sheets fed from the sheet holder;

a sheet feeder configured to feed the one or more sheets held in the sheet holder in a sheet conveyance direction toward the image forming unit;

a re-conveyance unit configured to re-convey, toward the image forming unit, the one or more sheets having passed through the image forming unit;

a first sensor configured to output a signal in response to detecting passage of each sheet fed by the sheet feeder; and a second sensor configured to output a signal in response to detecting passage of each sheet re-conveyed by the re-conveyance unit, the second sensor being located upstream of the first sensor;

a third sensor configured to output a signal in response to detecting passage of each sheet fed by the sheet feeder, the third sensor being located upstream of the second sensor; and, the instructions being configured to, when executed by the processor, cause the processor to:

begin to feed a preceding sheet by the sheet feeder;

acquire a passing time period during which the preceding sheet being fed by the sheet feeder is passing through the first sensor, based on the signal from the first sensor;

begin to re-convey the preceding sheet by the re-conveyance u nit;

begin to feed a subsequent sheet in response to the leading end of the preceding sheet being detected by the second sensor;

stop feeding the subsequent sheet at a predetermined position downstream of the sheet holder in the sheet conveyance direction in response to the leading end of the subsequent sheet being detected by the third sensor, the third sensor being located at the predetermined position;

in response to feeding of the subsequent sheet being set in the predetermined position after the preceding sheet has begun to be re-conveyed by the re-conveyance unit, calculate, based on the acquired passing time period during which the preceding sheet was passing through the first sensor, an adjustment time period between a point of time when a leading end of the preceding sheet re-conveyed by the re-conveyance unit is detected based on the signal from the second sensor and a point of time when the subsequent sheet is to resume being fed from the predetermined position toward the image forming unit by the sheet feeder, the adjustment time period being determined to be shorter as the acquired passing time period is shorter; and control the sheet feeder to feed the subsequent sheet from the predetermined position toward the image forming unit with timing adjusted based on the calculated adjustment time period.

10. The non-transitory computer-readable medium according to claim 9, wherein the sheet feeder comprises a separator configured to separate a plurality of sheets fed from the sheet holder, on a sheet-by-sheet basis, and wherein the instructions are configured to, when executed by the processor, cause the processor to control the sheet feeder to, after feeding the subsequent sheet from the sheet holder, stop the feeding of the subsequent sheet when a leading end of the subsequent sheet is positioned between the separator and the image forming unit.

11. The non-transitory computer-readable medium according to claim 9, wherein the instructions are configured to, when executed by the processor, cause the processor to control the image forming unit to start image formation on each sheet based on the signal from the first sensor.

12. The non-transitory computer-readable medium according to claim 9, wherein the image forming apparatus further comprises a registration unit configured to perform skew correction for each sheet to be fed to the image forming unit, and wherein the registration unit is disposed between the sheet feeder and the image forming unit in a sheet conveyance direction from the sheet holder toward the image forming unit, and disposed between the re-conveyance unit and the image forming unit in a sheet re-conveyance direction from the re-conveyance unit toward the image forming unit.

13. The non-transitory computer-readable medium according to claim 12, wherein the first sensor is disposed between the registration unit and the image forming unit in the sheet conveyance direction.

14. The non-transitory computer-readable medium according to claim 12, wherein the second sensor is disposed between the sheet feeder and the registration unit in the sheet conveyance direction.

* * * * *